US006375417B1

(12) United States Patent
Hofer et al.

(10) Patent No.: US 6,375,417 B1
(45) Date of Patent: Apr. 23, 2002

(54) MOISTURE REMOVAL POCKET FOR IMPROVED MOISTURE REMOVAL EFFICIENCY

(75) Inventors: Douglas Carl Hofer; Nicholas Joseph Mollo, both of Clifton Park; Alan Donn Maddaus, Rexford, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/615,010

(22) Filed: Jul. 12, 2000

(51) Int. Cl.[7] ..... F01D 25/32
(52) U.S. Cl. ..... 415/169.4
(58) Field of Search ..... 415/169.2, 169.3, 415/169.4, 121, 144

(56) References Cited

U.S. PATENT DOCUMENTS

| | | | | |
|---|---|---|---|---|
| 2,121,645 A | * | 6/1938 | Warren | 415/121.2 |
| 3,058,720 A | | 10/1962 | Hart | |
| 5,261,785 A | | 11/1993 | Williams | |

FOREIGN PATENT DOCUMENTS

| | | | | |
|---|---|---|---|---|
| CZ | 125365 | | 11/1967 | |
| DE | 509 266 | | 10/1930 | |
| DE | 547332 A | * | 3/1932 | 415/169.3 |
| DE | 759 964 | | 4/1953 | |
| DE | 368403 | | 5/1963 | |
| DE | 1951922 A | * | 4/1971 | 415/169.4 |
| FR | 1 510 108 | | 1/1968 | |
| GB | 387361 A | * | 2/1933 | 415/169.4 |
| GB | 388156 A | * | 2/1933 | 415/169.4 |
| GB | 993 476 | | 5/1965 | |
| SU | 1386718 | | 4/1988 | |

* cited by examiner

*Primary Examiner*—Christopher Verdier
(74) *Attorney, Agent, or Firm*—Nixon & Vanderhye PC

(57) ABSTRACT

An improved moisture removal pocket configuration is described that includes an axial extension of the moisture removal slot over the bucket cover. The pocket may omit the upstream gutter segment to achieve the desired slot extension. The modified moisture removal pocket configuration improves the moisture removal efficiency by providing access to the pocket for water that moves as a film along the nozzle outer side wall and is entrained in the leakage jet above the bucket cover.

15 Claims, 2 Drawing Sheets

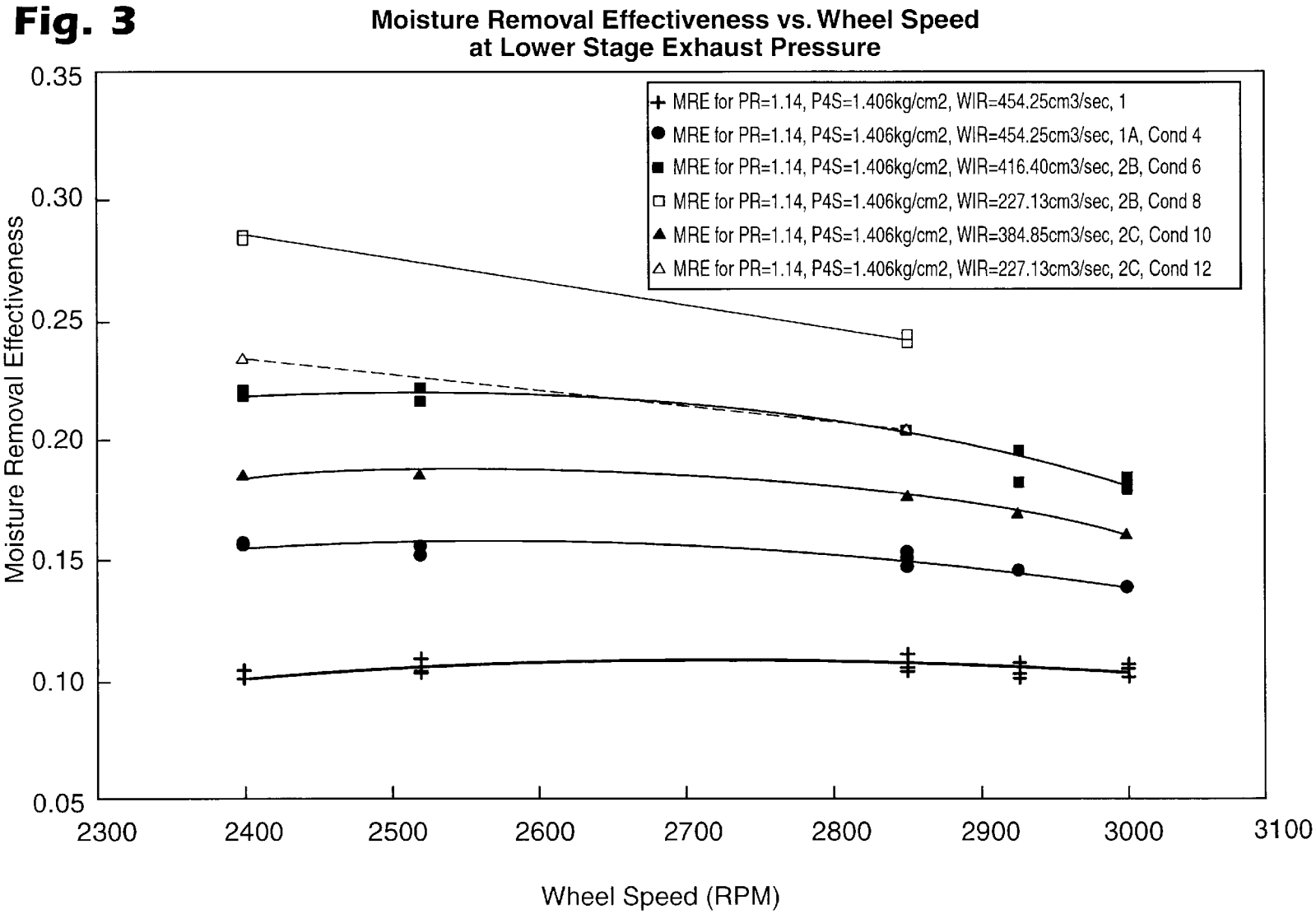
Fig. 3
Moisture Removal Effectiveness vs. Wheel Speed
at Lower Stage Exhaust Pressure
+ MRE for PR=1.14, P4S=1.406kg/cm2, WIR=454.25cm3/sec, 1
● MRE for PR=1.14, P4S=1.406kg/cm2, WIR=454.25cm3/sec, 1A, Cond 4
■ MRE for PR=1.14, P4S=1.406kg/cm2, WIR=416.40cm3/sec, 2B, Cond 6
□ MRE for PR=1.14, P4S=1.406kg/cm2, WIR=227.13cm3/sec, 2B, Cond 8
▲ MRE for PR=1.14, P4S=1.406kg/cm2, WIR=384.85cm3/sec, 2C, Cond 10
△ MRE for PR=1.14, P4S=1.406kg/cm2, WIR=227.13cm3/sec, 2C, Cond 12
Moisture Removal Effectiveness
0.35
0.30
0.25
0.20
0.15
0.10
0.05
2300
2400
2500
2600
2700
2800
2900
3000
3100
Wheel Speed (RPM)

MOISTURE REMOVAL POCKET FOR IMPROVED MOISTURE REMOVAL EFFICIENCY

BACKGROUND OF THE INVENTION

This invention relates to steam turbines and, more specifically, to an improved moisture removal pocket for providing an improved moisture removal efficiency.

Steam turbines frequently operate in the wet region, that is at pressures and temperatures that cause steam to condense so that a significant fraction of the mass flow is in the form of liquid water. The presence of liquid water in the steam vapor flow gives rise to a thermodynamic loss associated with accelerating water droplets to vapor velocity. In addition to degraded thermoefficiency, the moisture content can lead to increased water impact erosion of the later stage buckets.

Moisture removal pockets are commonly used to extract water from the flow path by collecting droplets centrifuged from the bucket trailing edge surfaces. A more recent approach for removing this moisture is to groove the leading edges of the buckets (or blades) to capture the water and to use centrifugal force generated by the rotating turbine rotor to drive the water out to stationary moisture collection devices or pockets. The collection efficiency of such moisture removal pockets, however, is quite low; typically on the order of 10 to 20%. The prior art includes a great number of configurations adapted to remove moisture from the moisture laden motive steam passage of the steam turbine. A number of these configurations have included various combinations of multiple slots, pockets, baffles, segmented bucket covers, side wall scoops and the like. However, a need remains for a moisture removal device providing a higher efficiency than the 10–20% efficiency noted above.

BRIEF SUMMARY OF THE INVENTION

A moisture removal pocket configuration and disposition is proposed as an embodiment of the invention to provide a significant improvement to moisture removal efficiency. The moisture removal device of the invention is easy to produce and involves no components that would disturb the flow of steam vapor phase. As described below, the invention proposes to modify an existing design in a manner which meets low disturbance and producibility requirements.

More specifically, the invention is embodied in the provision of a moisture removal pocket having a slot for the flow of moisture thereinto, wherein a substantial portion of the slot axially overlaps a respective bucket cover. The substantial overlap provides access to the pocket for water that moves as a film along the nozzle outer side wall and is entrained in the leakage jet above the bucket cover. The substantial overlap may be provided by eliminating an upstream gutter segment of the conventional moisture removal pocket, so that the overlap can be achieved while meeting axial space in constraints.

BRIEF DESCRIPTION OF THE DRAWINGS

These, as well as other objects and advantages of this invention, will be more completely understood and appreciated by careful study of the following more detailed description of the presently preferred exemplary embodiments of the invention taken in conjunction with the accompanying drawings, in which:

FIG. 3 is a graph of moisture removal effectiveness versus wheel speed illustrating an improved efficiency exhibited with the structure of an embodiment of the invention.

DETAILED DESCRIPTION OF THE INVENTION

The invention will now be described in greater detail with reference to the standard configuration and an exemplary modification thereof as an embodiment of the invention.

Figure 1:
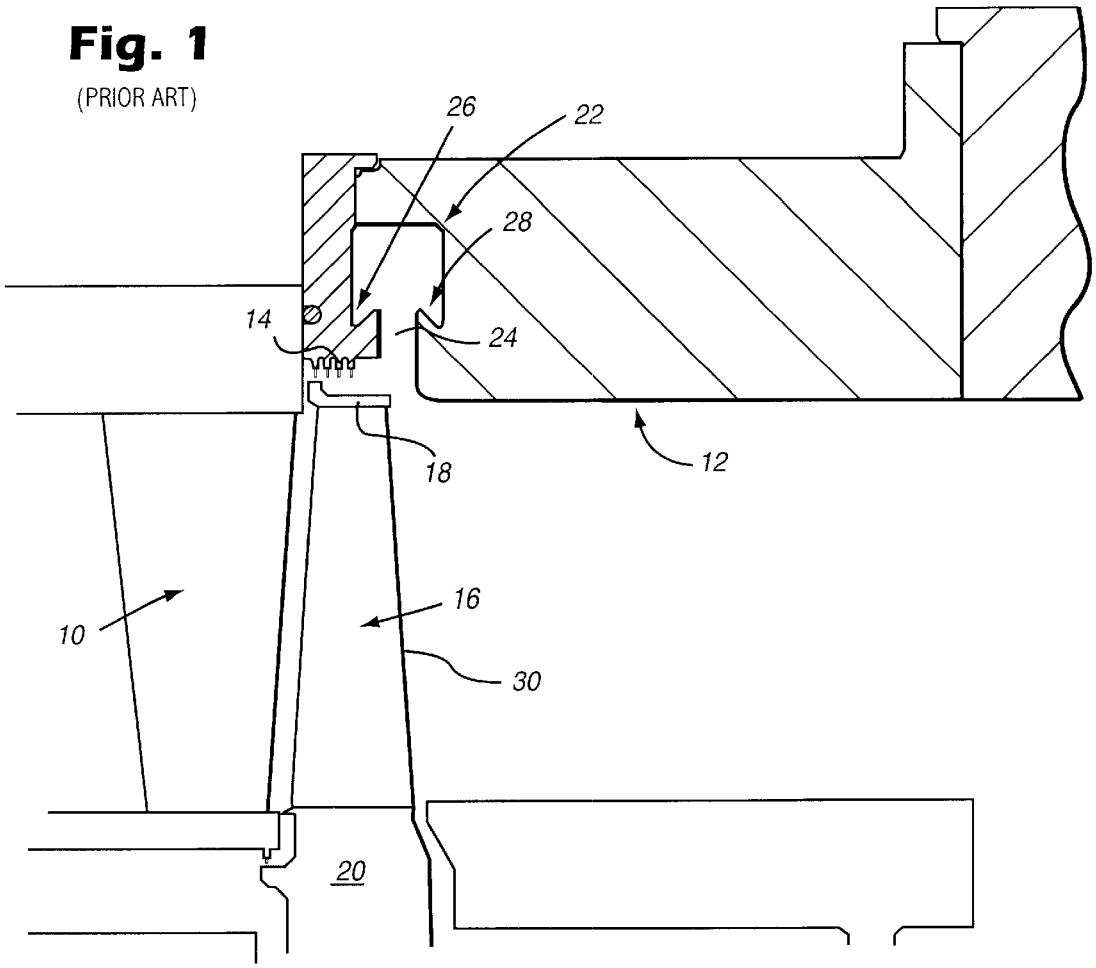
Fig. 1 (PRIOR ART)
FIG. 1 is a schematic axial section of a portion of a turbine showing a conventional moisture removal pocket.

A standard configuration of turbine stage components is shown in schematic axial cross-section in FIG. 1. As illustrated, the stage includes a nozzle row 10, outer side wall 12, bucket tip leakage seal 14, a bucket row 16 with bucket covers 18 mounted on a wheel 20, and a moisture removal pocket 22. In this example, the moisture removal pocket 22 has a slot 24 for the passage of moisture thereinto, an upstream gutter 26, and a downstream gutter 28. In this standard configuration, the trailing edge 30 of the bucket 16 is generally aligned radially with the center line of the slot 24. As a result, at the bucket tip, there is very little axial overlap of the upstream portion of the slot and the bucket cover 18. In this assembly, the moisture removal pocket 22 is disposed to extract water from the steam flow by collecting droplets centrifuged from the bucket trailing edge surfaces; hence, the alignment of the slot 24 with the bucket trailing edge 30. However, water also moves as a film along the nozzle outer side wall. This water can become entrained in the leakage jet above or radially outside the bucket cover 18. This moisture has not heretofore been effectively removed with the conventional moisture removal pocket 22 illustrated in FIG. 1.

Figure 2:
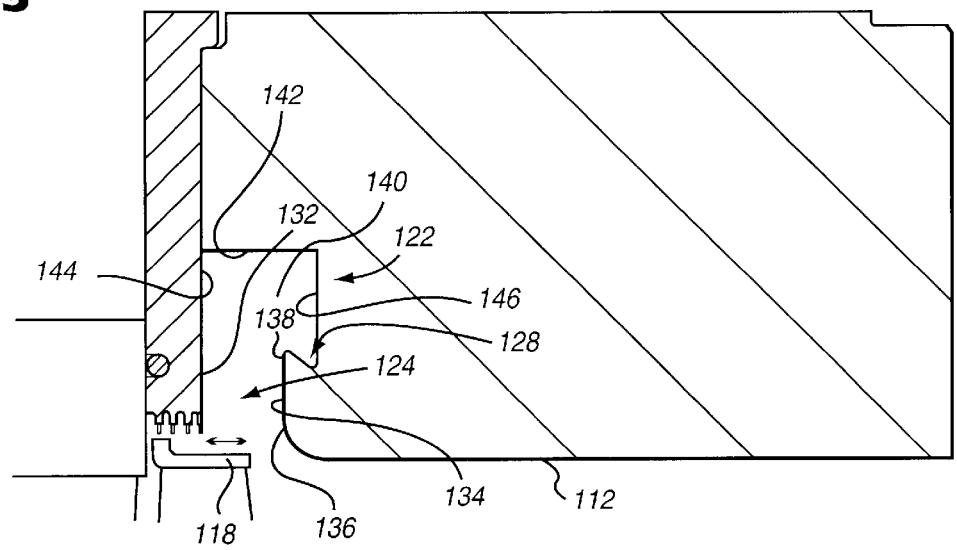
FIG. 2 is an axial section of a portion of a turbine showing an improved moisture removal pocket as the embodiment of the invention.

The invention is embodied in a modification to the moisture removal configuration illustrated in FIG. 1 that provides for a significant overlap of the moisture collecting slot and the bucket cover. More specifically, as illustrated in FIG. 2, the invention provides a configuration wherein a significant portion of the moisture collecting slot 124 axially overlaps the bucket cover 118. In the illustrated embodiment, the slot downstream surface 134 is disposed in a manner that generally corresponds to the disposition of the downstream surface 34 of the slot 24 of the FIG. 1 conventional configuration. However, the upstream portion of the slot and in particular the slot upstream surface 132 is more spaced, in the presently preferred embodiment of the invention, from the downstream surface 134 than in the conventional configuration. More specifically, in the illustrated embodiment, the axial dimension of the slot 124 is increased, as compared to the conventional slot axial dimension defined by the distance between surfaces 32 and 34 thereof, by at least about 30% and up to about 100%, so that there is substantial overlap of the slot and the bucket cover.

In the embodiment illustrated in FIG. 2, to enlarge the slot 124 and increase the overlap with the bucket cover 118, the upstream gutter 26 of the moisture removal pocket 24 of the FIG. 1 assembly has been eliminated so that the upstream wall 132,144 of the moisture removal pocket 122 is defined in a substantially radial plane, as is shown in FIG. 2. In the embodiment illustrated in FIG. 2, the slot 124 overlaps the bucket cover 118 (also referred to herein as bucket tip) by at least about 25% to about 75% of the axial length of the bucket cover and more preferably by about 50% of the axial length of that cover. Moreover, in the presently preferred embodiment of FIG. 2, at least about 50% of the axial length of the slot 124 overlays the bucket cover 118. In the illustrated embodiment, furthermore, it can be seen that the slot walls 132, 134 extend in generally radial planes, transverse to the axial flow direction A of the working fluid in the flow path defined by the outer side wall 112. Thus, the axial dimension of the slot 124 is generally constant, in a preferred embodiment of the invention, from a radial inner, entrance end 136 to the slot 124 and a radially outer, gutter communicating end 138 of the slot 124.

In the illustrated embodiment, the chamber 140 of the moisture removal pocket 122 includes a radially outer wall 142, an upstream axial wall 144 generally transverse to the radially outer wall and a downstream axial wall 146 generally transverse to the radially/ outer wall 142, and extends at least part circumferentially of the bucket row. As mentioned above, the upstream gutter segment of the conventional configuration is omitted, if necessary, to meet axial spacing constraints. Thus, in the illustrated embodiment, the upstream wall 132 of slot 124 is generally contiguous with and in a same plane with the upstream axial wall 144 of the chamber 140 of the moisture removal pocket 122. Otherwise, a widening of the slot 124 to an axial upstream is adopted. This provides access to the pocket 122 for the water that moves as a film along the outer side wall and that may be entrained in the leakage jet above the bucket cover 118. This improves efficiency of moisture removal. In the illustrated embodiment, similar to the conventional structure, the moisture removal pocket 122 further includes a downstream gutter groove 128 defined intermediate the downstream wall 134 of the slot 124 and a downstream radial wall 146 of the chamber 140 of the pocket.

Tests were conducted to provide a comparison of Moisture Removal Effectiveness (MRE) between the standard configuration of the type illustrated in FIG. 1 and the presently preferred configuration illustrated in FIG. 2. The test results are shown in graph form in FIG. 3. The tests 1 and 1A were conducted with the standard configuration of FIG. 1. The tests 2B and 2C were all conducted with the configuration of FIG. 2. As illustrated, the increase in MRE of the preferred configurations as compared to the standard configuration was on the order of 40%. This confirms our hypothesis that (1) the water moves as a film along the nozzle outer side wall and becomes entrained in the leakage jet above the bucket cover, which limits the moisture removal efficiency of the conventional configuration, and (2) a pocket having a slot providing for substantial axial overlap to the bucket cover improves the moisture removal efficiency by providing access to the pocket for that otherwise entrained water.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An axial flow steam turbine including:

a rotor;

a radially extending bucket carried by the rotor, said bucket having a leading edge, a trailing edge, and a radially outer tip, an outer side wall disposed radially outwardly of said bucket and generally co-axial to said rotor, thereby defining a working fluid flow path; and a moisture removal pocket defined in said outer side wall, said moisture removal pocket including a chamber for receiving moisture and a slot for communicating said chamber to said working fluid flow path for allowing moisture flow radially from said flow path into said chamber of said moisture removal pocket, said slot including an axially upstream wall and an axially downstream wall, said axial downstream wall opening to said flow path axially downstream of said trailing edge of said bucket and said axially upstream wall of said slot opening to said flow path radially outside said bucket whereby said slot substantially overlaps said radially outer tip of said bucket, wherein said moisture removal pocket further includes a downstream gutter groove defined intermediate said downstream wall of said slot and a downstream radial wall of said chamber, and wherein said upstream wall of said slot is generally contiguous with and in a same plane with an upstream axial wall of the chamber of said moisture removal pocket.

2. An axial flow steam turbine as in claim 1, wherein said downstream wall of said slot is defined in a generally radial plane, transverse to the axis of said rotor.

3. An axial flow steam turbine as in claim 1, wherein said upstream wall of said slot is defined in a generally radial plane transverse to said axis of said rotor.

4. An axial flow steam turbine as in claim 1, wherein said slot overlaps with at least about 25% of said bucket tip.

5. An axial flow steam turbine as in claim 4, wherein said slot overlaps between about 25 and 75% of said bucket tip.

6. An axial flow steam turbine as in claim 5, wherein said slot overlaps with 50% of an axial dimension of said bucket tip.

7. An axial flow steam turbine as in claim 1, wherein at least about 25% and no more than about 75% of said slot is disposed to overlay said bucket tip.

8. An axial flow steam turbine as in claim 7, wherein about 50% of an axial dimension of the slot overlies said bucket tip.

9. An axial flow steam turbine as in claim 1, wherein said chamber of said moisture removal pocket includes a radially outer wall, an upstream axial wall generally transverse to said radially outer wall and a downstream axial wall generally transverse to said radially outer wall and extends at least part circumferentially of said rotor.

10. An axial flow steam turbine including:

a rotor;

a radially extending bucket carried by the rotor, said bucket having a leading edge, a trailing edge, and a radially outer tip, an outer side wall disposed radially outwardly of said bucket and generally coaxial to said rotor, thereby defining a working fluid flow path; and a moisture removal pocket defined in said outer side wall, said moisture removal pocket including walls defining a chamber for receiving moisture and a slot for communicating said chamber to said working fluid flow path for allowing moisture flow radially from said flow path into said chamber of said moisture removal pocket, said walls defining said chamber including a radially outer wall, an upstream axial wall generally transverse to said radially outer wall and a downstream axial wall generally transverse to said radially outer wall, said slot including an axially upstream wall that is generally contiguous with and in a same plane with said upstream axial wall of the chamber and an axially downstream wall, said axial downstream wall opening to said flow path axially downstream of said trailing edge of said bucket and said axially upstream wall of said slot opening to said flow path radially outside said bucket whereby said slot substantially overlaps said radially outer tip of said bucket, wherein said moisture removal pocket further includes a downstream gutter groove defined intermediate said downstream wall of said slot and said downstream radial wall of said chamber.

11. An axial flow steam turbine as in claim 10, wherein said downstream wall of said slot is defined in a generally radial plane, transverse to the axis of said rotor.

12. An axial flow steam turbine as in claim 10, wherein said slot overlaps with at least about 25% of said bucket tip.

13. An axial flow steam turbine as in claim 12, wherein said slot overlaps between about 25 and 75% of said bucket tip.

14. An axial flow steam turbine as in claim 13, wherein said slot overlaps with about 50% of an axial dimension of said bucket tip.

15. An axial flow steam turbine as in claim 10, wherein at least about 25% and no more than about 75% of said slot is disposed to overlay said bucket tip.

* * * * *